United States Patent [19]

Noren et al.

[11] 4,038,176

[45] July 26, 1977

[54] OIL SOLUBLE POLYMERIC FLOCCULANTS

[75] Inventors: Gerry K. Noren, Hoffman Estates, Ill.; Richard C. Diehl, Oakdale, Pa.

[73] Assignee: Calgon Corporation, Pittsburgh, Pa.

[21] Appl. No.: 668,894

[22] Filed: Mar. 22, 1976

[51] Int. Cl.[2] ..... C10M 11/00

[52] U.S. Cl. ..... 208/180

[58] Field of Search ..... 208/180

[56] References Cited

U.S. PATENT DOCUMENTS

| | | | |
|---|---|---|---|
| 2,294,461 | 9/1942 | Jones | 208/180 |
| 2,435,734 | 2/1948 | Bray et al. | 208/180 |
| 2,609,931 | 9/1952 | Rodman et al. | 208/180 |
| 3,450,627 | 6/1969 | Johnson | 208/180 |
| 3,563,885 | 2/1971 | Talbot | 208/180 |
| 3,985,642 | 10/1976 | Friel et al. | 208/180 |

*Primary Examiner*—Delbert E. Gantz
*Assistant Examiner*—James W. Hellwege
*Attorney, Agent, or Firm*—Rudolph J. Anderson, Jr.; Harry E. Westlake, Jr.; Martin L. Katz

[57] ABSTRACT

Use of oil soluble cationic polymers as flocculants for the purification of used motor oil. Polymers useful in the process of the instant invention include oil soluble polymers such as fatty acid salts of cationic polymers.

6 Claims, No Drawings

OIL SOLUBLE POLYMERIC FLOCCULANTS

This invention relates to the purification of waste oils.

More particularly, this invention relates to the use of oil soluble cationic polymers as aids in the recovery and purification of used oils. Cationic polymers which are soluble in oil may be useful flocculants for the coagulation of colloidal suspensions in oil.

Heretofore, commercial processes which have been used for the purification of waste oils have been classified as either acid/clay processes or distillation processes.

The acid/clay process generally consists of three basic steps: (1) steam stripping of the volatiles at 300° F.; (2) a 24–48 hour treatment with about 4–6 volume percent of 93% sulfuric acid; and (3) treatment with about 0.4 lbs. of clay per gallon of oil followed by filtration.

The distillation process consists of two basic steps: a settling or centrifugation step followed by vacuum distillation. Heretofore, many organic chemicals have been used to aid in the settling step of the distillation process. For example, U.S. Pat. No. 2,568,583 discloses the use of N-phenyldiethanolamine in the settling step of the distillation process; U.S. Pat. No. 2,822,320 discloses the use of hydrazine in the settling step of the distillation process; U.S. Pat. No. 3,142,636 discloses the use of guanidine carbonate in the settling step of the distillation process; U.S. Pat. No. 2,943,046 discloses the use of salts of low fatty acids in the settling step of the distillation process; U.S. Pat. No. 3,222,275 discloses the use of ethylene sulfate in the settling step of the distillation process; U.S. Pat. No. 2,951,031 discloses the use of monoisopropanolamine in the settling step of the distillation process; U.S. Pat. No. 3,123,549 discloses the use of diazomethane in the settling step of the distillation process; U.S. Pat. No. 3,282,827 discloses the use of tetronic polyol (701 and 702) in the settling step of the distillation process; and U.S. Pat. No. 3,305,478 discloses the use of diethylenetriamine in the settling step of the distillation process.

We have found that oil soluble cationic polymers may also be used as aids in the settling of colloidal suspensions for the reclamation of waste oils.

Polymers useful in the process of the instant invention include oil soluble polymers such as fatty acid salts of cationic polymers. Suitable fatty acids such as oleic, stearic, myriatic and palmetic acid may be used and the preferred compounds are the oleic acid salts of polymers of tertiary-amino substituted acrylamides such as 3-acrylamido-3-methylbutyl dimethylamine, (3-methacrylamidopropyl)dimethylamine and methacryloyloxyethyl dimethylamine or fatty diallyl ($C_6$–$C_{24}$) quaternary ammonium salts such as diallyldodecylmethyl ammonium chloride. It is preferred that the molecular weight of these polymers be in the range of 10,000 to 10,000,000, preferably from 50,000 to 1,000,000, and that these polymers be used in a concentration of from 0.01% to 5% (based on the weight of waste oil being treated). In order to improve the effectiveness of these polymers in treating certain waste oils, it may be preferable to reduce the viscosity of the oil being treated by blending with benzene or other suitable solvents or by heating.

Processes of the instant invention may be illustrated by the following examples:

EXAMPLE 1

A hornopolymer of 3-acrylamido-3-methylbutyl dimethylamine was prepared using t-butylperoxy pivalate as a free radical initiator and benzene as a solvent. The polymer was soluble in benzene but was insoluble in No. 2 fuel oil. The stoichiometric amount of oleic acid (1 equivalent per amine) was added and the resultant polymeric salt was soluble in No. 2 fuel oil. The structure of the polymer is believed to be:

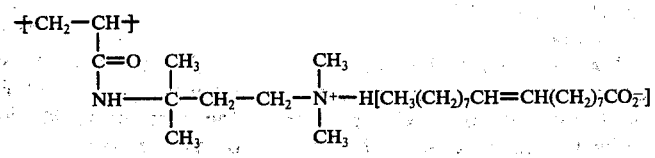

EXAMPLE 2

A homopolymer was prepared from diallyldodecylmethyl ammonium chloride using t-butylperoxy pivalate as a free radical initiator and benzene as a solvent. The structure of this polymer is:

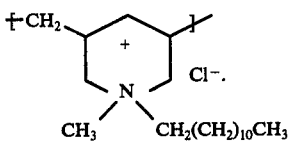

EXAMPLE 3

The flocculating ability of these polymers is demonstrated by a test procedure in which 0.6 g of a 15% lampblack in mineral oil suspension is added to a test tube. To this suspension is added 0.1 g of the polymeric flocculant, 0.2 ml of water and 25 ml of No. 2 fuel oil. The test tube is capped and vigorously shaken and the settling time is observed and recorded as set forth on the following table:

Table I

| Polymer | Settling Time |
|---|---|
| Example 1 | 30 Seconds |
| Example 2 | 5 Minutes |
| No Additive | 2 Hours |

EXAMPLE 4

A batch of waste motor oil (100 ml) was treated with 1 ml of a 25% solution of the oleic acid salt of poly(3-acrylamido-3-methylbutyl dimethylamine) and heated at 75°–80° C for 8hr. and produced 6 ml of sediment, Similarly, 50 ml of oil was blended with 50 ml of benzene and treated with 1 ml of a 25% solids solution of diallyldodecylmethyl ammonium chloride and 2 ml of sediment was observed.

EXAMPLE 5

A 50% solution of (3-methacrylamidopropyl)dimethylamine in benzene is heated to 60° C over a period of 1 hr. with a nitrogen purge and t-butylperoxy pivalate initiator is added and heating is removed to allow exotherm to 70° C where the temperature is maintained by cooling for 6 hr. The viscous polymer solution is diluted to 27% non-volatiles with benzene and a stoichiometric amount of oleic acid is added to neutralize the tertiary-amine. More benzene is added to obtain the desired percent non-volatile oleic acid salt of poly MAPDA.

EXAMPLE 6

The polymer produced by the procedure of Example 5 at 2.5% solids in benzene was found to successfully flocculate 10% carbon black in mineral oil (synthetic oil sludge) at 6–10 drops (~ .3–. 5 ml) within 30 minutes. Without the polymer, the suspension does not settle out for at least 12–24 hrs.

We claim:

1. A method of reclaiming waste oils which comprises adding at least 0.01 percent, based on the weight of waste oil, of an oil soluble polymer to the waste oil in order to flocculate the colloidal suspensions contained in said oil, said oil soluble polymer having a molecular weight of a l least 10,000 and being selected from the group consisting of polymers of fatty diallyl quaternary ammonium salts and fatty acid salts of polymers of tertiary amino substituted acrylamides.

2. A method of claim 1 where the polymer is a polymer of diallyldodecylmethyl ammonium chloride.

3. A method as in claim 1 wherein the polymer is a fatty acid salt of a homopolymer of a tertiary-amino substituted acrylamide.

4. A method as in claim 3 wherein the polymer is the oleic acid salt of a homopolymer of a tertiary-amino substituted acrylamide.

5. A method as in claim 4 wherein the tertiary-amino substituted acrylamide is 3-acrylamido-3-methylbutyl dimethylamine.

6. A method as in claim 4 wherein the tertiary-amino substituted acrylamide is (3-methacrylamidopropyl)-dimethylamine.

* * * * *

UNITED STATES PATENT OFFICE

CERTIFICATE OF CORRECTION

PATENT NO. : 4,038,176

DATED : July 26, 1977

INVENTOR(S) : Gerry K. Noren and Richard C. Diehl

It is certified that error appears in the above-identified patent and that said Letters Patent are hereby corrected as shown below:

Column 2, Example 1, line 8, "hornopolymer" should read -- homopolymer --.

Column 4, Claim 1, line 2, "weight of a l least 10,000" should read -- weight of at least 10,000 --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*